US011059314B2

(12) United States Patent
Ohnishi

(10) Patent No.: US 11,059,314 B2
(45) Date of Patent: Jul. 13, 2021

(54) PRINTING METHOD, AND METHOD FOR MANUFACTURING SCREEN PRINTING PLATE

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 160 days.

(21) Appl. No.: 16/133,726

(22) Filed: Sep. 18, 2018

(65) Prior Publication Data

US 2019/0084333 A1 Mar. 21, 2019

(30) Foreign Application Priority Data

Sep. 19, 2017 (JP) ..... JP2017-178795

(51) Int. Cl.

| | |
|---|---|
| ***B41N 1/24*** | (2006.01) |
| ***B41F 15/36*** | (2006.01) |
| ***B41C 1/14*** | (2006.01) |
| ***B41M 1/12*** | (2006.01) |

(52) U.S. Cl.

CPC ..... *B41N 1/247* (2013.01); *B41C 1/14* (2013.01); *B41C 1/147* (2013.01); *B41F 15/36* (2013.01); *B41M 1/12* (2013.01); *B41N 1/248* (2013.01)

(58) Field of Classification Search

None

See application file for complete search history.

(56) References Cited

U.S. PATENT DOCUMENTS 3,407,726 A * 10/1968 Rosengren ..... G03F 7/12 430/308
5,303,647 A * 4/1994 Seo ..... B41N 1/248 101/125
5,819,653 A * 10/1998 McCue ..... B41C 1/147 101/128.21

(Continued)

FOREIGN PATENT DOCUMENTS

| | | |
|---|---|---|
| JP | 2005271450 | 10/2005 |
| JP | 2009051062 | 3/2009 |
| JP | 2015131456 | 7/2015 |

OTHER PUBLICATIONS

Office Action of Japan Counterpart Application, with English translation thereof, dated Feb. 9, 2021, pp. 1-10.

*Primary Examiner* — Jill E Culler
(74) *Attorney, Agent, or Firm* — JCIPRNET

(57) ABSTRACT

A printing method that carries out printing using a mesh screen, which is a screen gauze including multiple holes, is provided. The printing method includes: a covering process of covering one surface of the mesh screen with a covering member; an entering process of entering the covering member to at least a middle of the hole from a side of the one surface with respect to the multiple holes of the mesh screen; a mask forming process of ejecting a mask forming liquid used to form a mask that covers one part of an other surface of the mesh screen from an ejection head, to form the mask; a peeling process of peeling the covering member from the mesh screen; and a print executing process of printing an image corresponding to a pattern of the mask on the medium using the mesh screen and the printing ink.

7 Claims, 3 Drawing Sheets

(56) References Cited

U.S. PATENT DOCUMENTS

| | | | | |
|---|---|---|---|---|
| 6,038,971 | A * | 3/2000 | Fischer | B41C 1/14 101/128.4 |
| 6,076,459 | A * | 6/2000 | Berner | B41C 1/148 101/128.4 |
| 2003/0051801 | A1 * | 3/2003 | Usami | B41C 1/147 156/240 |

* cited by examiner

PRINTING METHOD, AND METHOD FOR MANUFACTURING SCREEN PRINTING PLATE

CROSS REFERENCE TO RELATED APPLICATIONS

This application claims the priority benefit of Japanese Patent Application No. 2017-178795, filed on Sep. 19, 2017. The entirety of the above-mentioned patent application is hereby incorporated by reference herein and made a part of this specification.

TECHNICAL FIELD

The present disclosure relates to a printing method, a liquid ejecting device, and a method for manufacturing a screen printing plate.

DESCRIPTION OF THE BACKGROUND ART

A screen printing method, which is a method of carrying out printing using a mesh screen (screen gauze), is conventionally known (see e.g., Japanese Unexamined Patent Publication No. 2015-131456). In the screen printing method, the printing with respect to a medium (media, body to be transferred) to be printed is usually carried out by forming a mask (screen mask) with a pattern corresponding to an image to be printed on the screen gauze.

Patent Literature: Japanese Unexamined Patent Publication No. 2015-131456

SUMMARY

When carrying out printing through the screen printing method, for example, a plate for printing (printing plate) is created by forming a mask with a photoresist film, and the like using a screen gauze made of a chemical fiber mesh such as polyester and nylon, a wire mesh such as metal, an etching mesh, or the like. The image is printed by rubbing ink against a medium through the printing plate using a rubber edge such as a squeegee, a rubber roller, and the like while the printing plate is brought into contact with the medium. Furthermore, in the screen printing method, the printing can be carried out on various media using various inks by carrying out printing in such manner. More specifically, in this case, for example, even an ink that cannot be ejected from an inkjet head in the printing (inkjet method) using the inkjet head can be appropriately used. Thus, the printing is widely adopted in industrial applications, and the like with the screen printing method.

However, when creating the printing plate through the method described above, for example, a masking work including a process of coating a photoresist film for masking in advance, a process of developing, and the like is required. In such a case, a great amount of time and cost are required for the work. Furthermore, equipments such as light exposure machine, solvent bath, and the like are necessary to carry out such masking work. Moreover, a developing solution of the photoresist film cannot be drained through the drain outlet, and the like as is, and thus needs to be processed as industrial waste, and the like. In this case, a request to a specialized business operator usually becomes necessary. Thus, when carrying out printing through the conventional screen printing method, the cost of printing may become extremely high due to increase in the equipment cost and the work cost.

In recent years, on the other hand, consideration is made to form the mask of the screen gauze using the inkjet head, and the like. However, the viscosity of the ink usually needs to be made extremely low in order to appropriately eject ink from the inkjet head. In this case, even if the ink is ejected onto the screen gauze, the ink passes through to the back side of the screen gauze, and hence the mask may become difficult to be appropriately formed.

With respect to such problem, for example, consideration is made to use an inkjet head capable of ejecting an ink having high viscosity that is difficult to be ejected with a general inkjet head, an ink containing a filler having a large particle size, and the like. For such inkjet head, for example, consideration is made to use a configuration of ejecting the ink with a strong force by increasing the diameter of the nozzle and increasing the displacement amount of a piezo element that causes the ink to be ejected from the nozzle. However, when using such special inkjet head, not a general inkjet printer for image printing but a printer using a large diameter nozzle corresponding to high viscosity is required, which greatly increases the cost of the equipment. Furthermore, there is a limit to higher viscosity of the ink and larger particle size of the filler of the ink that can be ejected through such method, and even if such special inkjet head is used, there is a concern that the inkjet head is only used for an ink corresponding to one part of the ink required to form the mask. Moreover, when using the ink containing a filler of large particle size, an extra device such as an ink circulating device is further required to prevent precipitation of the filler.

Thus, it is conventionally desired to more appropriately carry out printing in the screen printing method. The present disclosure provides a printing method, a liquid ejecting device, and a method for manufacturing a screen printing plate capable of solving the problems described above.

The inventors of the present application conducted a thorough research on a method of more appropriately carrying out printing through the screen printing method. Furthermore, a method of forming a mask on a screen gauze using an ink of low viscosity that can be ejected even with a general inkjet head, and the like was reviewed with respect to a specific method. With regards to this, when forming the mask with the ink of low viscosity, the ink may pass through to the back side of the screen gauze and the mask may become difficult to be appropriately formed, as described above. In order to prevent the ink from passing through to the back side of the screen gauze, for example, a sheet, a film, or the like may be attached to the back side of the screen gauze. In relation to such configuration, JP2015-131456 describes attaching a viscosity film to a mesh screen for the purpose of preventing dripping of the ink, passing of the ink to the back side of the screen gauze, and the like.

However, the inventors of the present application found out through thorough research that the mask cannot be appropriately formed by merely attaching the sheet, the film, and the like in some cases. More specifically, for example, the inventors found out that when forming the mask with the film, and the like attached to one surface of the screen gauze, the ink can be prevented from passing through to the back side but defects such as a pinhole may easily be formed in the formed mask. Moreover, through further thorough research, the inventors found out that its cause may be related to the fact that the ink used for forming the mask excessively enters the hole configuring the mesh of the screen gauze.

The inventors of the present application thus considered entering the film into the hole configuring the mesh of the screen gauze as well as simply attaching a film, and the like to one surface of the screen gauze. According to such configuration, for example, the ink used for forming the mask can be appropriately prevented from excessively entering the hole of the screen gauze. Furthermore, the formation of pinholes, and the like thus can be suppressed, and the mask can be more appropriately formed.

Furthermore, through further thorough research, the inventor of the present application found features necessary for obtaining such effects and contrived the present disclosure. In order to solve the problems described above, the present disclosure provides a printing method that carries out printing using a screen gauze including a plurality of holes for passing a printing ink, which is an ink to be attached to a medium to be printed, the printing method including a covering process of covering one surface of the screen gauze with a covering member, which is a member different from the screen gauze; an entering process of entering the covering member to at least a middle of the hole from a side of the one surface with respect to the plurality of holes of the screen gauze; a mask forming process of ejecting a mask forming liquid, which is a liquid used to form a mask that covers one part of an other surface of the screen gauze, from an ejection head, the mask forming process including ejecting the mask forming liquid from the ejection head based on a pattern set in advance to form the mask; a peeling process of peeling the covering member from the screen gauze; and a print executing process of printing an image corresponding to a pattern of the mask on the medium using the screen gauze formed with the mask and the printing ink.

When configured in such manner, for example, the mask forming liquid, which is the liquid (ink, etc.) used to form the mask, can be appropriately prevented from excessively entering the hole by forming the mask with the covering member entered into the hole of the screen gauze. Furthermore, for example, the formation of pinholes, and the like thus can be suppressed, and the mask can be more appropriately formed. Thus, according to such configuration, for example, the printing through the screen printing method can be more appropriately carried out.

Furthermore, in such configuration, a flexible film member, and the like, for example, can be suitably used for the covering member. According to such configuration, for example, the covering member can be appropriately entered into the hole of the screen gauze. Moreover, for example, a repeelable film, and the like can be suitably used for the covering member. In this case, the repeelable film is, for example, a film that can be peeled without substantially influencing another member after being attached to the another member. For example, a film, and the like that can be attached to the screen gauze without using a sticky adhesive (e.g., glue, various types of adhesives, etc.) can be suitably used for the repeelable film. For example, a commercially available known repeelable film, and the like can be suitably used for such repeelable film.

The covering member is preferably weakly adhered to the screen gauze. More specifically, the manner of attaching the covering member to the screen gauze is, for example, preferably configured such that the covering member is attached to one surface of the screen gauze in a state where the adhesive substantially does not remain on the one surface of the screen gauze after the covering member is peeled from the screen gauze in the peeling process. In this case, when referring to the adhesive substantially not remaining, for example, this means that the stickiness does not remain on the one surface of the screen gauze after the covering member is peeled. Furthermore, when referring to the stickiness not remaining, this means that unnecessary stickiness does not substantially remain in a range desired in the application of the screen gauze. When referring to the adhesive substantially not remaining, this is not limited to a case in which the adhesive is used at the time of attachment and the adhesive does not remain at the time of peeling, and for example, includes a case in which the adhesive is not used at the time of attachment.

Furthermore, the amount to enter the covering member with respect to the hole of the screen gauze is preferably a sufficient amount with respect to the thickness of the mask formed on the screen gauze. In this case, the thickness of the mask is, for example, a design thickness in a state where the mask is completed. More specifically, when a thickness of the mask formed on the other surface of the screen gauze in the mask forming process is assumed as t, a depth of the hole in a thickness direction of the screen gauze is assumed as d, and an amount to enter the covering member into the hole in the entering process is assumed as x, the covering member is preferably entered into the hole to satisfy $d-x<t$ in the entering process. According to such configuration, for example, the mask can be formed on the screen gauze while more appropriately maintaining the continuity between the position of the hole and the periphery thereof. Thus, for example, the formation of the pinholes and the like can be more appropriately suppressed and the mask can be more appropriately formed. Furthermore, in the entering process, the covering member may be entered into the hole until the covering member projects out from the other surface of the screen gauze. Furthermore, in this case, the projection amount of the covering member is preferably smaller than the thickness t of the mask. Even when configured in such manner, for example, the mask can be formed on the screen gauze while appropriately maintaining the continuity between the position of the hole and the periphery thereof.

In this configuration, for example, if the mask forming liquid is strongly attached to the covering member in excess, the covering member may be peeled with the mask forming liquid attached at the time of peeling of the covering member. In this case, one part of the mask forming liquid is removed with the covering member, and the pinholes, and the like may be formed in the mask. Thus, the strength of attachment of the mask forming liquid is preferably configured such that the strength of attachment to the portion entered into the hole of the screen gauze in the covering member is not too strong. In this case, the strength of attachment of the mask forming liquid is, for example, the strength of attachment at the timing of peeling the covering member in the peeling process. More specifically, the strength of attachment of the mask forming liquid to the portion entered into the hole of the screen gauze in the covering member is preferably weaker than the strength of attachment of the mask forming liquid with respect to the other surface of the screen gauze. Furthermore, in this case, a member formed with a material that satisfies such conditions is preferably used for the covering member.

In such configuration, for example, a known screen printing ink can be used for the printing ink. Furthermore, for example, an ultraviolet curable ink and the like that cures by irradiation of an ultraviolet light can be suitably used for the mask forming liquid. A known ultraviolet curable ink, and the like that can be ejected from an inkjet head, for example, can be suitably used for the ultraviolet curable ink. Moreover, a liquid having a viscosity of smaller than or equal to 20 mPa·s is preferably used for the mask forming liquid. According to such configuration, for example, the mask forming liquid can be appropriately ejected using a widely prevalent and general inkjet head. In this case, an inkjet head that ejects the mask forming liquid through the inkjet scheme and the like can be suitably used for the ejection head.

Configurations of a liquid ejecting device and a method for manufacturing a screen printing plate having features similar to the above can be considered for the configuration of the present disclosure. In this case as well, for example, effects similar to the above can be obtained.

According to the present disclosure, for example, the printing through the screen printing method can be more appropriately carried out.

BRIEF DESCRIPTION OF THE DRAWINGS

FIGS. 1A to 1F schematically show an operation of each stage in the printing method of the present example.

FIG. 2A shows a state in which the covering member 30 is attached to the mesh screen 204 and the ink mask 152 is formed with one part of the mesh screen 204 and the covering member 30 enlarged. FIG. 2B shows one example of an operation of peeling the covering member 30 from the mesh screen 204. FIG. 2C shows one example of an operation of peeling a highly viscosity film 60 from the mesh screen 204 when using the highly viscosity film 60 in place of the covering member 30.

DETAILED DESCRIPTION OF EMBODIMENTS

Hereinafter, an embodiment according to the present disclosure will be described with reference to the drawings. FIGS. 1A to 1F are views describing a printing method according to one embodiment of the present disclosure. FIGS. 1A to 1F schematically show an operation of each stage in the printing method of the present example. Excluding the points described below, the printing method of the present example may have features same as or similar to a known printing method carried out by using a screen gauze.

The printing method of the present example is a method of carrying out printing through a screen method using a mesh screen 204 serving as an example of a screen gauze, and carries out printing using a framed printing screen 20 in which the mesh screen 204 is stretched across a frame portion 202. In this case, the screen gauze is, for example, a member having porosity including a plurality of holes for passing ink (printing ink) to be attached to a medium 50 to be printed when carrying out screen printing. Furthermore, in the present example, a known screen gauze can be suitably used for the mesh screen 204, which is the screen gauze. More specifically, a screen gauze made of a chemical fiber mesh such as polyester and nylon, a wire mesh such as metal, an etching mesh, or the like can be suitably used for the mesh screen 204.

Figure 1A:
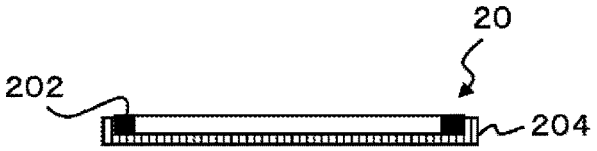
FIGS. 1A to 1F are views describing a printing method according to one embodiment of the present disclosure.
Figure 1B:
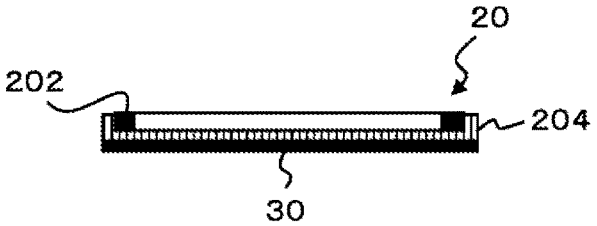

Furthermore, in the printing operation carried out in the present example, for example, the framed printing screen 20 in which the mesh screen 204 is stretched across the frame portion 202 is first prepared, as shown in FIG. 1A. A covering member 30, which is a member different from the mesh screen 204, is attached to one surface of the mesh screen 204 in the framed printing screen 20, for example, as shown in FIG. 1B. In this case, the operation of attaching the covering member 30 to the mesh screen 204 is an example of an operation of a covering process of covering one surface of the mesh screen 204 with the covering member 30.

A flexible film member, and the like, for example, can be used for the covering member 30. According to such configuration, for example, the covering member 30 can be appropriately entered into a hole of the mesh screen 204. More specifically, in the present example, a repeelable film, for example, is used for the covering member 30. In this case, the repeelable film is, for example, a film that can be peeled without substantially influencing another member after being attached to the another member. Furthermore, the repeelable film can also be considered as, for example, a viscosity film that can be repeeled. For example, a film, and the like that can be attached to the mesh screen 204 without using a viscous adhesive (e.g., known glue, various types of adhesives, etc.) can be suitably used for the repeelable film. For example, a commercially available known repeelable film, and the like can be suitably used for such repeelable film.

Furthermore, in the present example, the covering member 30 is entered into a plurality of holes (opening portion of the mesh) in the mesh screen 204 by pressing the covering member 30 against the mesh screen 204 rather than by simply attaching the covering member 30 to the mesh screen 204. In this case, entering the covering member 30 into the holes of the mesh screen 204 means entering the covering member 30 to at least the middle of the hole from one surface side of the mesh screen 204 so that the covering member 30 enters a gap of the meshes (between meshes). Furthermore, in this case, the operation of entering the covering member 30 into the holes of the mesh screen 204 is an example of an operation of an entering process. Moreover, in the present example, the operation of entering the covering member 30 into the holes of the mesh screen 204 is carried out by, for example, pressing the covering member 30 against the mesh screen 204 with, for example, a nail, and the like of the worker. The operation of entering the covering member 30 into the holes of the mesh screen 204 will be described in further detail later.

Figure 1C:
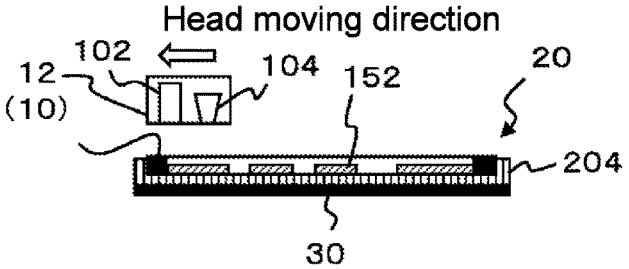
Figure 1D:
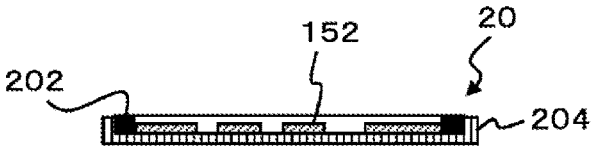

After covering the mesh screen 204 with the covering member 30 and entering the covering member 30 into the holes of the mesh screen 204, an ink mask 152 is formed on a surface (other surface) on a side opposite the surface covered with the covering member 30 in the mesh screen 204, as shown in FIG. 1C. In this case, the operation of forming the ink mask 152 is an example of an operation of a mask forming process. Furthermore, the ink mask 152 is, for example, a film for masking that covers the other surface of the mesh screen 204 to prevent the printing ink from passing through, and is formed in accordance with an image to be printed on the medium 50 so as to cover some holes in the mesh screen 204. Moreover, forming the ink mask 152 in accordance with the image to be printed means forming the ink mask 152 so as to cover a region corresponding to a portion where the printing ink is not to be attached in the medium 50, similar to, for example, a known mask used in the screen printing.

More specifically, in the present example, the formation of the ink mask 152 is carried out using a printing device 10 including a head unit 12 that ejects a mask forming ink, which is an ink used to form the mask. In this case, the mask forming ink is an example of a mask forming liquid, which is a liquid used to form the mask. Furthermore, in the present example, the printing device 10 is an inkjet printer, and uses an inkjet ink, which is an ink that can be ejected through the inkjet scheme, for the mask forming ink. In this case, an ink having a viscosity of smaller than or equal to 20 mPa·s is preferably used for the mask forming ink. According to such configuration, for example, the mask forming ink can be appropriately ejected using a widely prevalent and general inkjet head.

Furthermore, in the present example, an ultraviolet curable ink (UV curable ink) that cures by irradiation of an ultraviolet light is used for the mask forming ink. In this case, for example, a known ultraviolet curable ink, and the like that can be ejected from the inkjet head can be suitably used. Furthermore, the head unit 12 includes an inkjet head 102 and an ultraviolet light source 104 in correspondence with the feature of the mask forming ink. The inkjet head 102 is an example of an ejection head, and ejects the mask forming ink through the inkjet scheme to a surface on a side opposite the surface covered by the covering member 30 in the mesh screen 204 based on a pattern set in advance in accordance with the image to be printed. The ultraviolet light source 104 is a light source (UV light source) that emits an ultraviolet light for curing the mask forming ink, and emits the ultraviolet light on the mask forming ink landed on the mesh screen 204 to cure the mask forming ink. The printing device 10 thereby forms the ink mask 152, which is a printed film of ultraviolet curable ink, on the mesh screen 204.

When using the mask forming ink having a low viscosity that can be ejected by the inkjet head 102, a great amount of mask forming ink may pass through the holes of the mesh screen 204 before being cured if ejection is simply carried out to the mesh screen 204. In this case, a mask pass-through in which the mask forming ink passes through occurs in a region where the ink mask 152 is to be originally formed, and the ink mask 152 may become difficult to be appropriately formed. In the present example, on the other hand, the covering member 30 is attached to a surface on a side opposite the surface formed with the ink mask 152 in the mesh screen 204, as described above. Thus, according to the present example, for example, the pre-cured mask forming ink can be appropriately prevented from passing through the holes of the mesh screen 204. Furthermore, the mask pass-through, and the like can be appropriately prevented, and the ink mask 152 can be appropriately formed with high precision.

Considering such functions of the covering member 30, the covering member 30 can also be considered as, for example, a member that assists the formation of the ink mask 152, and the like. Furthermore, in order to more reliably prevent the mask pass-through, for example, consideration is made to further increase the amount of mask forming ink to be ejected with respect to the same position of the mesh screen 204 according to the configuration of the mesh screen 204 to use, the properties of the mask forming ink, and the like. More specifically, in this case, for example, consideration is made to carry out the operation of application of ejecting the mask forming ink with the inkjet head 102 over plural times with respect to the same position of the mesh screen 204. According to such configuration, for example, the ink mask 152 can be more appropriately formed with high precision.

Furthermore, in the present example, after forming the ink mask 152 on the mesh screen 204, the covering member 30 is peeled and removed from the mesh screen 204. In this case, the operation of peeling the covering member 30 is an example of an operation of a peeling process. Furthermore, in this case, by peeling the covering member 30, the framed printing screen 20 is in a state formed with the ink mask 152 functioning as the mask for screen printing, as shown, for example, in FIG. 1D. Thus, in the present example, the screen printing plate to be used for screen printing can be considered as completed at a stage where the covering member 30 is peeled.

Figure 1E:
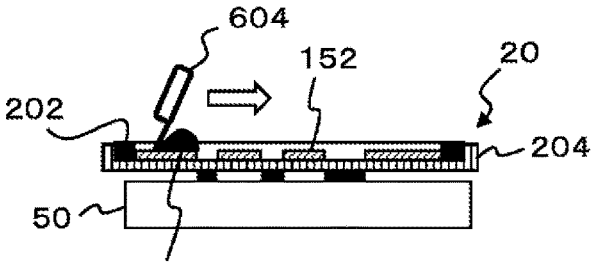
Figure 1F:
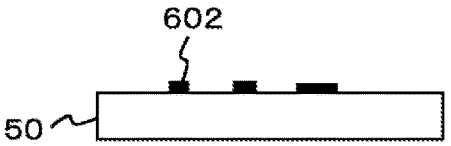

Moreover, in the present example, the subsequent operation of printing can be carried out by same as or similar to the operation of the known screen printing. In this case, after peeling the covering member 30, for example, as shown in FIG. 1E, an ink 602, which is an ink for screen printing (printing ink), is used, and the ink 602 is passed through the holes in the region where the ink mask 152 is not formed in the mesh screen 204 to attach the ink 602 to the medium 50. According to such configuration, for example, the image corresponding to the pattern of the ink mask 152 can be appropriately printed on the medium 50. In this case, the operation of attaching the ink 602 to the medium 50 is an example of an operation of a print executing process. Furthermore, in this case, for example, consideration is made to rub the ink 602 to the medium 50 through the ink mask 152 using a known squeegee 604, and the like. Moreover, various types of rubber edges, rubber rollers, and the like other than the squeegee 604 may be used to rub the ink onto the medium 50.

After attaching the ink 602 to the medium 50, the framed printing screen 20 is removed, and an operation for fixing the ink 602 to the medium 50 is carried out, as necessary, and whereby an operation (image print) of screen printing on the medium 50 is completed. Furthermore, in this case, the medium 50 at the stage where the printing is completed is in a state where the ink 602 is attached to one part of a to-be-printed surface, as shown, for example, in FIG. 1F.

A known ink for screen printing, and the like can be suitably used for the ink 602. More specifically, for example, inorganic ink containing water or solvent such as organic solvent, an inorganic ink containing a material (UV curable material) that cures by the ultraviolet light, an ink containing ceramic, glaze, metal, metal oxide, heat resistant resin, or the like can be suitably used for the ink 602. In this case, consideration is made to carry out an operation of drying the ink 602 or an operation of curing the ink by the irradiation of the ultraviolet light according to the ink 602 to be used for the operation for fixing the ink 602 to the medium 50. Moreover, consideration is made to carry out drying, baking, and the like at high temperature for the operation for fixing the ink 602 to the medium 50 depending on the type of ink 602. More specifically, for example, when printing a ceramic image, and the like, such operation is sometimes required. In such a case, for example, consideration is made to heat the medium 50 attached with the ink 602 in an oven, sintering furnace, and the like after detaching the framed printing screen 20.

Therefore, according to the present example, the screen printing with respect to the medium 50, for example, can be appropriately carried out. Furthermore, in this case, the reduction in the cost of the necessary devices can be realized while reducing the equipments necessary for forming the ink mask 152 by forming the ink mask 152 using the printing device 10. Furthermore, in this case, for example, the work cost can be reduced because the ink mask 152 can be formed by simply feeding the image data corresponding to the ink mask 152 to be formed to the printing device 10. Thus, for example, the time required to create the screen printing plate can be greatly reduced. Furthermore, in this case, the cost required to create the plate can be reduced, and whereby the printing through screen printing becomes easy to carry out even, for example, in applications where the number of media 50 (number of prints) to print the same image is small.

Furthermore, consideration is made to use an ink that can be removed from the mesh screen 204 after use, for example, for the mask forming ink used to form the ink mask 152. More specifically, in this case, for example, consideration is made to use a remeltable ultraviolet ink (remeltable UV curable ink), and the like such as an ultraviolet curable ink having water solubility or solvent availability. According to such configuration, for example, the mesh screen 204 can be reused by washing the mesh screen 204 with water or solvent that dissolves the mask forming ink after using the mesh screen 204. Furthermore, the running cost can be more appropriately reduced even when, for example, used in applications where the number of prints is small.

In the present example, the ink mask 152 can be more appropriately formed by entering the covering member 30 into the holes of the mesh screen 204 using the flexibility of the covering member 30 rather than strongly attaching the covering member 30 with respect to the mesh screen 204 with an adhesive, and the like. The state in which the covering member 30 is attached to the mesh screen 204, the operation of entering the covering member 30 into the holes of the mesh screen 204, and the like will be hereinafter described in further detail.

Figure 2A:
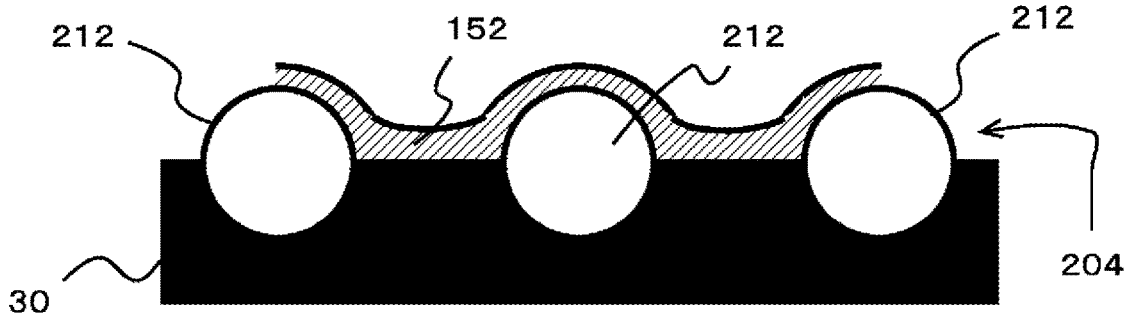
FIGS. 2A to 2C are views describing a state in which a covering member 30 is attached to a mesh screen 204 in further detail.
Figure 2B:
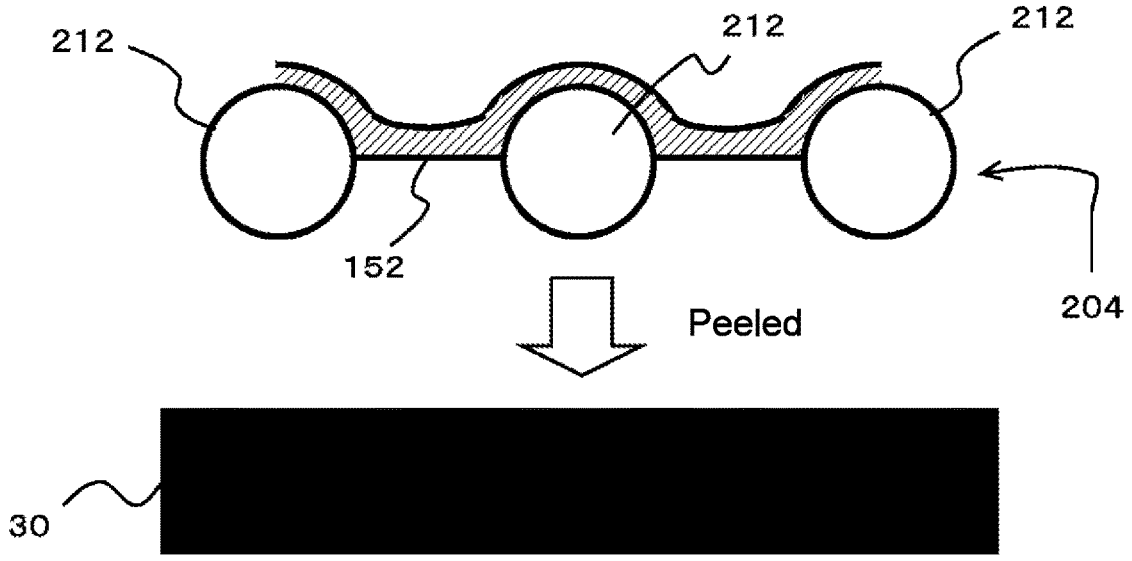
Figure 2C:
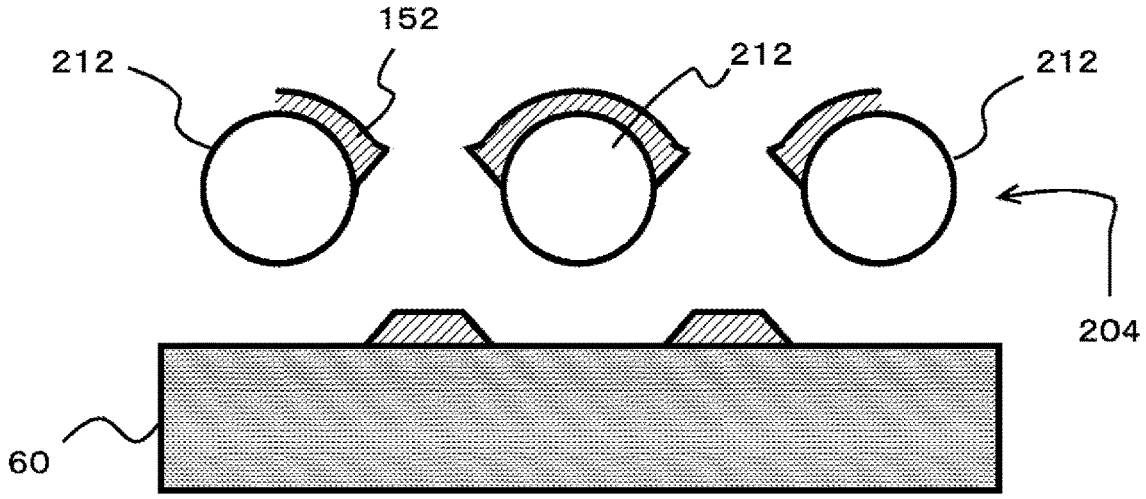

FIGS. 2A to 2C are views describing a state in which the covering member 30 is attached to the mesh screen 204 in further detail. FIG. 2A shows a state in which the covering member 30 is attached to the mesh screen 204 and the ink mask 152 is formed with one part of the mesh screen 204 and the covering member 30 enlarged. Furthermore, in FIG. 2A, a state of a masking portion, which is a portion where the ink mask 152 is formed, is schematically shown as one part of the mesh screen 204 and the covering member 30. As described above, in the present example, the mesh screen 204 is a screen gauze for screen printing. In this case, the mesh screen 204 is, for example, in a mesh-form in which holes are formed between wire rods 212, as shown in the figure. Furthermore, the ink mask 152 is formed to block the holes between the wire rods 212 by being continuously formed on a plurality of wire rods 212. Moreover, in this case, for example, the ink mask 152 is formed with the covering member 30 pressed against the mesh screen 204 with a strong force (with the covering member 30 strongly attached to the mesh screen 204).

As also described above, in the present example, the ink mask 152 is formed with the inkjet head 102 (see FIG. 1C) using the mask forming ink having low viscosity. In this case, when attempting to form the ink mask 152 without using the covering member 30, the pre-cured mask forming ink passes through the holes of the mesh screen 204 to the back side of the mesh screen 204. As a result, the mask pass-through is assumed to easily occur. More specifically, in this case, a great number of pinholes (hole punching), and the like is assumed to be formed in the ink mask 152. In the present example, on the other hand, the mask forming ink can be appropriately prevented from passing through to the back side of the mesh screen 204 by forming the ink mask 152 with the covering member 30 attached to the mesh screen 204. Furthermore, in this case, the mask forming ink does not pass through to the back side of the mesh screen 204, and thus the mask forming ink necessary for forming the ink mask 152 can be appropriately reduced. Moreover, as the ink required to form the ink mask 152 is reduced, the ink mask 152 can be formed using a widely prevalent and general inkjet head without using, for example, a special inkjet head, and the like having a nozzle of large diameter.

In this case, however, the formation of pinholes, and the like may not be sufficiently prevented by simply attaching the covering member 30 to the mesh screen 204. More specifically, for example, in this case, as a great amount of ink flows into the holes of the mesh screen 204, the mask forming ink remaining on the wire rod 212 may be deficient, and pinholes and the like may be formed. Furthermore, a difference may be formed in the height of the upper surface of the ink mask 152 between the portion on the wire rod 212 in the ink mask 152 and the portion of the hole between the wire rods 212, and the ink mask 152 may become a step-form due to the configuration of continuously forming the ink mask 152 on the plurality of wire rods 212 and blocking the hole between the wire rods 212. In this case, if the difference in height at the step is large, for example, a portion where connection of the ink mask 152 is weak may be formed at the step position, and the like, and pinholes, cracks, and the like may easily be formed in the ink mask 152.

On the contrary, in the present example, the covering member 30 is not merely attached to the mesh screen 204, but the covering member 30 is entered into the holes of the mesh screen 204, as described above. According to such configuration, for example, the mask forming ink can be appropriately prevented from entering into the holes of the mesh screen 204 in excess, and a sufficient amount of ink can be left on the wire rod 212. Furthermore, for example, the formation of pinholes and the like due to the deficiency of the mask forming ink remaining on the wire rod 212 can be appropriately prevented. Moreover, in this case, even if a step is formed at the upper surface of the ink mask 152, for example, the difference in height at the step can be appropriately reduced, as shown in the figure. Thus, according to the present example, the formation of pinholes, and the like can be appropriately suppressed compared to, for example, a case where the covering member 30 is simply attached to the mesh screen 204.

Furthermore, in the present example, the formation of pinholes, and the like is more reliably prevented as will be described below using FIGS. 2B and 2C by using, for example, a repeelable film for the covering member 30. FIG. 2B shows one example of an operation of peeling the covering member 30 from the mesh screen 204. FIG. 2C shows one example of an operation of peeling a highly viscosity film 60 from the mesh screen 204 when using the highly viscosity film 60 in place of the covering member 30.

As described above, in the present example, the covering member 30 is attached to the mesh screen 204, and furthermore, the covering member 30 is entered into the hole of the mesh screen 204 to form the ink mask 152 on the mesh screen 204 while preventing the formation of pinholes, and the like. Thereafter, as shown in FIG. 2B, the covering member 30 is peeled from the mesh screen 204 to complete the screen printing plate. However, in this case, for example, if the mask forming ink is strongly attached to the covering member 30, the covering member 30 may be peeled with one part of the ink mask 152 attached to the covering member 30. As a result, one part of the ink mask 152 is removed with the covering member 30, and the pinholes and the like may be formed in the ink mask 152.

More specifically, for example, as shown in FIG. 2C, when the highly viscosity film 60 and the like having strong stickiness with respect to the mask forming ink than the covering member 30 is used in place of the covering member 30, the ink mask 152 may not be able to withstand the force with which the highly viscosity film 60 pulls the ink mask 152 at a timing of peeling the highly viscosity film 60 from the mesh screen 204, and whereby one part of the ink mask 152 may detach from the mesh screen 204 and the film configuring the ink mask 152 may be broken. As a result, even if the pinholes and the like are not formed before peeling the highly viscosity film 60, the pinholes and the like tend to be easily formed thereafter. Furthermore, in this case, if the opening of the hole of the mesh screen 204 is wide, in particular, the pinholes, and the like are assumed to be easily formed. On the contrary, according to the present example, even when the opening of the hole of the mesh screen 204 is wide, for example, new pinholes and the like can be appropriately prevented from being formed at the time of peeling the covering member 30 by using the repeelable film, and the like for the covering member 30. Furthermore, the screen printing plate thus can be more appropriately created with high precision.

As apparent from the description made above, a member which strength (adhesiveness) of attachment of the mask forming ink is sufficiently weak is preferably used for the covering member 30. More specifically, in this case, the strength of attachment of the mask forming ink with respect to the covering member 30 in the hole of the mesh screen 204 is preferably weaker than the strength of attachment of the mask forming ink with respect to the surface on a side opposite the covering member 30 in the mesh screen 204. In this case, the strength of attachment of the mask forming liquid with respect to the surface on the side opposite the covering member 30 in the mesh screen 204 is, for example, the strength of attachment of the mask forming liquid with respect to the wire rod 212 of the mesh screen 204. Furthermore, the strength of attachment of the mask forming ink is, for example, the strength of attachment at the timing of peeling the covering member 30. Moreover, in this case, for example, if the covering member 30 has a property of repelling the mask forming ink, the pinholes and the like may be formed by the influence of the mask forming ink being repelled at the portion where the mask forming ink and the covering member 30 are brought into contact in the hole of the mesh screen 204. Thus, a member that blends with the mask forming ink and to which the cured mask forming ink does not strongly attach is preferably used for the covering member 30. Furthermore, the feature of such covering member 30 can be considered as, for example, a state of being weaker than a case where the mask forming ink is attached to the surface on the side opposite the covering member 30 in the mesh screen 204 and a state in which the mask forming ink attaches to the surface to be brought into contact with the mesh screen 204 in the covering member 30.

Furthermore, when using such covering member 30, the covering member 30 is assumed to be attached even to the mesh screen 204 with a weak force. In this case, a relationship between the covering member 30 and the mesh screen 204 can be considered as, for example, being attached in a state where the adhesive substantially does not remain after the peeling with respect to one surface of the mesh screen 204. When referring to the adhesive substantially not remaining, for example, this means that the stickiness does not remain on one surface of the mesh screen 204 after the covering member 30 is peeled. Furthermore, when referring to the stickiness not remaining, this means that unnecessary stickiness does not remain in a range desired in the application of the mesh screen 204. When referring to the adhesive substantially not remaining, this is not limited to a case in which the adhesive is used at the time of attachment and the adhesive does not remain at the time of peeling, and for example, includes a case in which the adhesive is not used at the time of attachment. More specifically, a film, and the like that is not attached with the adhesive force of the adhesive but attached with Van der Waals' force, static electricity, and the like without using the adhesive can be suitably used for the repeelable film, and the like used as the covering member 30. Moreover, a known repeelable film, and the like can be suitably used, as described above, for such repeelable film. Furthermore, for example, a tape-shape repeelable tape, and the like can be used for the known repeelable film.

A member other than the repeelable film may be used for the covering member 30 if the member can be appropriately entered into the hole of the mesh screen 204 and can be peeled without forming pinholes, and the like. In this case, for example, consideration is made to use a rubber film such as silicone rubber, fluorocarbon rubber, and the like. Furthermore, for example, consideration is also made to use a film applied with a mold release agent, and the like. Not limited to the film shape or tape shape covering member 30, use of a pad-shape covering member 30 is also considered. In this case, for example, consideration is made to use a rubber pad which adhesiveness with respect to the mask forming ink is sufficiently small and that can be easily deformed, and the like for the covering member 30. Moreover, consideration is made to use a plate-shaped member such as, for example, Teflon (registered trademark) plate, propylene plate, fluoride coated plate, and the like for the covering member 30. Even when using such covering member 30, for example, the covering member 30 can be caused to enter the hole of the mesh screen 204 by pressure contacting the covering member 30 with respect to the mesh screen 204 with a sufficiently strong force. Furthermore, for example, the ink mask 152 thus can be appropriately formed while appropriately preventing the mask forming ink from passing through to the back side of the mesh screen 204, the formation of pinholes, and the like. In this case as well, new pinholes, and the like can be appropriately prevented from being formed at the time of peeling by using the covering member 30 having a sufficiently small adhesiveness with respect to the mask forming ink.

Figure 3:
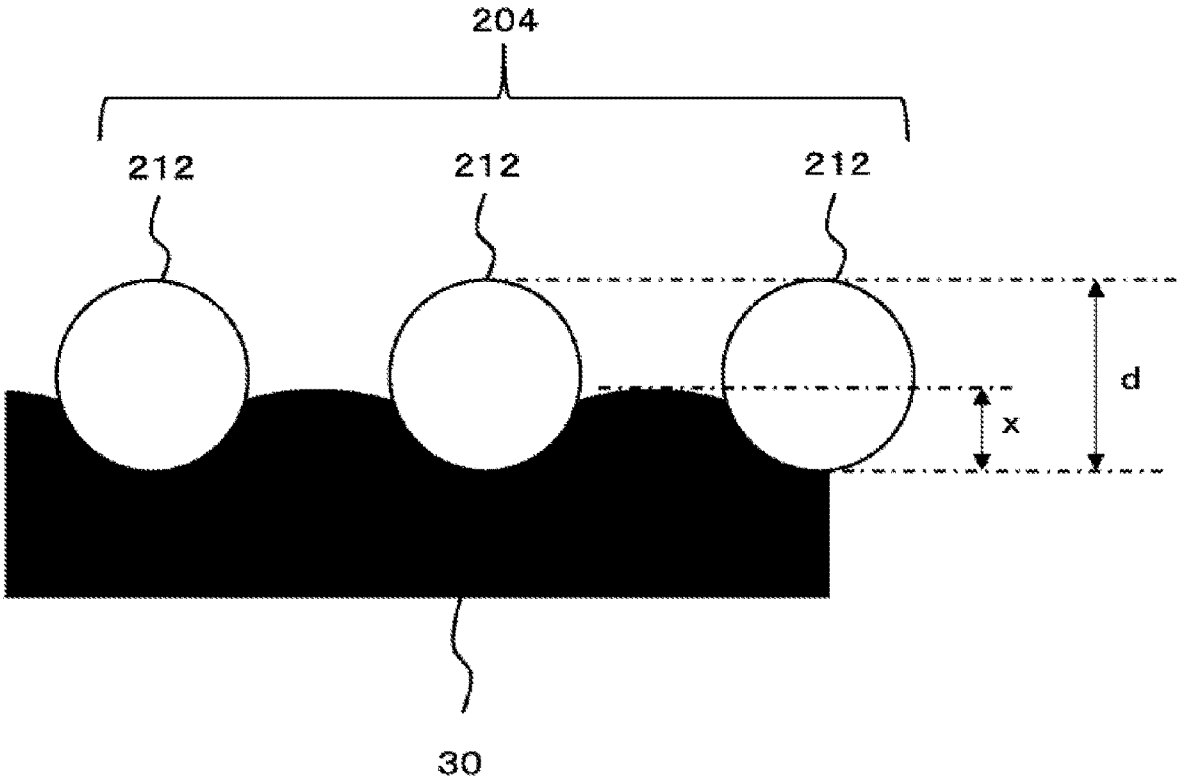
FIG. 3 is a view describing a state in which the covering member 30 is entered into a hole of the mesh screen 204 in further detail.

Next, the operation of entering the covering member 30 into the hole of the mesh screen 204 will be described in further detail. FIG. 3 is a view describing a state in which the covering member 30 is entered into the hole of the mesh screen 204 in further detail, and shows the state in which the covering member 30 is entered into the hole of the mesh screen 204 (hole between the wire rods 212) with one part of the mesh screen 204 and the covering member 30 enlarged. Furthermore, in FIG. 3, the manner how the covering member 30 is entered into the hole of the mesh screen 204 is illustrated in a simplified manner while showing the features of the present example in more detail than FIGS. 2A to 2C for the sake of convenience of illustration. In a more specific configuration, the manner how the covering member 30 is entered is preferably configured such that for example, the upper surface of the portion entered into the hole is flat to a certain extent, and the wire rod 212 at the periphery of the hole and the covering member 30 in the hole are closely attached.

As described above, in the present example, the ink mask 152 (see FIG. 2A) is formed on the mesh screen 204 while preventing the formation of the pinholes, and the like by entering the covering member 30 into the hole of the mesh screen 204. In this case, the amount to enter the covering member 30 with respect to the hole of the mesh screen 204 is preferably a sufficient amount with respect to the thickness of the ink mask 152 formed on the mesh screen 204. In this case, the thickness of the ink mask 152 is a design thickness in a state where the ink mask 152 is completed (e.g., after cured). More specifically, in the present example, the thickness of the ink mask 152 can be considered as, for example, a thickness of the cured ink mask 152, and the like calculated from the amount of mask forming ink (ink amount per unit area) ejected with respect to a unit area to a region for forming the ink mask 152.

More specifically, in this case, increasing the amount to enter the covering member 30 corresponds to a case of making the depth of the hole in a state where the covering member 30 is entered therein shallow. Thus, having the amount to enter the covering member 30 to a sufficient amount with respect to the thickness of the ink mask 152 can be considered as, for example, having the depth of the hole in a state where the covering member 30 is entered therein sufficiently shallow with respect to the thickness of the ink mask 152. Furthermore, having the depth of the hole in a state where the covering member 30 is entered therein sufficiently shallow means, for example, having the depth of the hole sufficiently shallow to an extent that the formation, and the like of the pinhole of the ink mask 152 can be suppressed according to the desired quality and the like of printing.

Furthermore, in FIG. 3, a state in which the covering member 30 is entered into the hole of the mesh screen 204 is illustrated in a simplified manner for a case in which the thickness of the mesh screen 204 is assumed as d and the amount to enter the covering member 30 is assumed as x. In this case, the thickness d of the mesh screen 204 can be considered as, for example, a depth of the hole in the thickness direction of the mesh screen 204. Furthermore, the amount x to enter the covering member 30 can be considered as a distance (distance in the thickness direction of the mesh screen 204) and the like between the portion entered to the far end of the hole in the covering member 30 and the inlet of the hole. In this case, the depth of the hole in a state where the covering member 30 is entered therein becomes d−x. Thus, assuming the thickness of the ink mask 152 formed on the mesh screen 204 as t, it is preferable to have the depth d−x sufficiently shallow with respect to the thickness t of the ink mask 152.

A screen gauze having a thickness of about 50 to 200 μm is conventionally and widely used for the screen gauze for screen printing. Furthermore, in recent years, for example, a thinner screen gauze having a thickness of about 10 μm is sometimes used in accordance with the enhancement in the desired quality of printing. Thus, for example, consideration is made to use a configuration in which the thickness d is about 10 to 200 μm for the mesh screen 204 of the present example. Furthermore, focusing on the depth d−x of the hole in a state where the covering member 30 is entered therein, the depth d−x of the hole in a state where the covering member 30 is entered therein can be easily made small if the thickness of the mesh screen 204 is smaller. Thus, the thickness of the mesh screen 204 is preferably about 10 to 50 μm, and more preferably about 10 to 20 μm. According to such configuration, for example, even if the amount to enter the covering member 30 is small, the depth d−x of the hole in the state where the covering member 30 is entered therein can be made sufficiently small. Thus, the covering member 30 can be appropriately and sufficiently entered into the hole of the mesh screen 204 and the formation and the like of the pinholes can be more appropriately prevented.

More specifically, in this case, for example, consideration is made to enter the covering member 30 so as to satisfy $d-x<t$ with respect to the hole of the mesh screen 204. According to such configuration, for example, the ink mask 152 can be formed on the mesh screen 204 while more appropriately maintaining the continuity between the position of the hole and the periphery thereof. Thus, for example, the formation of the pinholes and the like can be more appropriately suppressed and the ink mask 152 can be more appropriately formed. Furthermore, when the thickness of the mesh screen 204 is particularly thin, for example, the covering member 30 may be entered into the hole so as to completely pass through the hole of the mesh screen 204. In this case, for example, consideration is made to enter the covering member 30 into the hole until the covering member 30 projects out from the surface for forming the ink mask 152 in the mesh screen 204. Furthermore, in this case, the projection amount of the covering member 30 is preferably smaller than the thickness t of the mask. Even when configured in such manner, for example, the ink mask 152 can be formed on the mesh screen 204 while appropriately maintaining the continuity between the position of the hole and the periphery thereof.

Therefore, according to the present example, for example, the ink mask 152 can be appropriately formed on the mesh screen 204 by using the printing device 10 (see FIG. 1C) while suppressing the formation of the pinholes, and the like. Thus, for example, the printing can be appropriately carried out using the mesh screen 204. Furthermore, in this case, for example, the ink mask 152 can be formed with high precision through a digital method by forming the ink mask 152 using the inkjet head 102 (see FIG. 1C) in the printing device 10. Furthermore, in this case, the operation of printing carried out in the present example can also be considered as, for example, an operation of digital screen print method, and the like. Moreover, in this case, the printing device 10 can be considered as, for example, a liquid ejecting device, and the like that ejects the mask forming ink (mask forming liquid). The operation of the method for manufacturing the screen printing plate, and the like can be considered for the operation until peeling the covering member 30 and completing the screen printing plate of the operation of printing carried out in the present example.

In the above description, the relationship between the covering member 30 and the screen mesh 204 has been described mainly for a case of entering the covering member 30 into the hole of the screen mesh 204. However, when using a repeelable member (repeelable film, etc.) for the covering member 30, the covering member 30 itself shows weak adhesiveness when the covering member 30 is brought into proximity to the screen mesh 204. Thus, the covering member 30 can also be considered as being attached to the screen mesh 204 by such weak adhesiveness. When the covering member 30 is attached to the screen mesh 204 with such weak adhesiveness, the covering member 30 can be appropriately peeled from the screen mesh 204 without breaking the ink mask that occurs when the highly viscosity film 60 shown in FIG. 2C is used, for example, after forming the ink mask. Thus, using the repeelable film, and the like for the covering member 30 can be considered as a feature having effects in such aspect. Moreover, in the description made above, the description is made omitting or simplifying the presence of such weak adhesiveness for the sake of convenience of explanation.

Moreover, in such a case, the adhesiveness of the covering member 30 with respect to the ink mask merely needs to be weak to prevent the breakage of the ink mask at the time of peeling of the covering member 30. In this case, stronger adhesiveness of the covering member 30 with respect to the screen mesh 204 is assumed to be preferable. Furthermore, when entering the covering member 30 into the hole of the screen mesh 204, the required entering amount is sometimes changed by the property of the surface of the screen mesh 204. More specifically, for example, when using the screen mesh 204 formed with a plastic material, and the like having a smooth surface, the breakage of the ink mask is assumed to be easily prevented, for example, even if the amount to enter the covering member 30 into the hole of the screen mesh 204 is small.

The operation of printing carried out in the present example and each configuration used in printing are not limited to the operation and the configuration described above, and can be variously modified. For example, consideration is made to use an ink other than the ultraviolet curable ink for the mask forming ink used to form the ink mask 152. In this case, for example, consideration is made to use an evaporation drying ink, which is an ink that is fixed by evaporation of a solvent. Furthermore, a quick drying ink that is less likely to cause smearing is preferably used for the evaporation drying ink. More specifically, in this case, the quick drying latex ink, and the like is preferably used. Furthermore, the color of the ink to be used for the mask forming ink and the printing ink is also not limited. For example, the printing ink is not limited to a specific color ink, and consideration is also made to use an ink of various colors and materials such as white color, metallic color, clear color, pearl color, and the like.

INDUSTRIAL APPLICABILITY

The present disclosure can be suitably used for, for example, a printing method.

What is claimed is:

1. A printing method that carries out printing using a screen gauze including a plurality of holes for passing a printing ink, which is an ink to be attached to a medium to be printed, the printing method comprising:

a providing process of providing a covering member that is a flexible film member;

a covering process of covering one surface of the screen gauze with the covering member, which is a member different from the screen gauze;

a performing process of performing an entering process by pressing the covering member from a side of the one surface of the screen gauze in a state where the covering member is brought into contact with the screen gauze against the plurality of holes of the screen gauze, and the covering member is entered into at least halfway through the holes;

a mask forming process of ejecting a mask forming liquid, which is a liquid used to form a mask that covers one part of an other surface of the screen gauze, from an ejection head, the mask forming process including ejecting the mask forming liquid from the ejection head based on a pattern set in advance to form the mask;

a peeling process of peeling the covering member from the screen gauze; and a print executing process of printing an image corresponding to a pattern of the mask on the medium using the screen gauze formed with the mask and the printing ink;

wherein the mask forming liquid is an ultraviolet curable ink that cures by irradiation of an ultraviolet light;

wherein the mask forming liquid is a liquid having a viscosity of smaller than or equal to 20 mPa·s, and the ejection head ejects the mask forming liquid through an inkjet scheme;

wherein during formation of the pattern, immediately after the ultraviolet curable ink being landed on and brought into contact with the screen gauze, the ultraviolet light is irradiated to cure the ultraviolet curable ink.

2. The printing method according to claim 1, wherein the covering member is a repeelable film.

3. The printing method according to claim 1, wherein in the covering process, the covering member is attached to the one surface of the screen gauze in a state where an adhesive substantially does not remain on the one surface after the covering member is peeled from the screen gauze in the peeling process.

4. The printing method according to claim 1, wherein the mask forming liquid is attached to a portion entered into the holes of the screen gauze in the covering member weaker than when attached to the other surface of the screen gauze.

5. The printing method according to claim 1, wherein when a thickness of the mask formed on the other surface of the screen gauze in the mask forming process is assumed as t, a depth of the hole in a thickness direction of the screen gauze is assumed as d, and an amount to enter the covering member into the hole in the entering process is assumed as x, the covering member is entered into the hole to satisfy $d-x<t$ in the entering process.

6. The printing method according to claim 1, wherein in the entering process, the covering member is entered into the hole until the covering member projects out from the other surface of the screen gauze.

7. A method for manufacturing a screen printing plate, which is a plate used in screen printing, the method comprising:

a covering process of covering one surface of a screen gauze including a plurality of holes for passing a printing ink, which is an ink to be attached to a medium to be printed, with a covering member that is a flexible film member and is a member different from the screen gauze;

an entering process of pressing the covering member from a side of the one surface of the screen gauze in a state where the covering member is brought into contact with the screen gauze against the plurality of holes of the screen gauze, and the covering member is entered into at least halfway through the holes;

a mask forming process of ejecting a mask forming liquid, which is a liquid used to form a mask that covers one part of an other surface of the screen gauze, from an ejection head, the mask forming process including ejecting the mask forming liquid from the ejection head based on a pattern set in advance to form the mask; and a peeling process of peeling the covering member from the screen gauze;

wherein the mask forming liquid is an ultraviolet curable ink that cures by irradiation of an ultraviolet light;

wherein the mask forming liquid is a liquid having a viscosity of smaller than or equal to 20 mPa·s, and the ejection head ejects the mask forming liquid through an inkjet scheme;

wherein during formation of the pattern, immediately after the ultraviolet curable ink being landed on and brought into contact with the screen gauze, the ultraviolet light is irradiated to cure the ultraviolet curable ink.

* * * * *